US006761610B2

(12) United States Patent
Fisher et al.

(10) Patent No.: US 6,761,610 B2
(45) Date of Patent: Jul. 13, 2004

(54) ASHTRAY WITH LEVITATING CIGARETTE LIGHTER AND OTHER OBJECTS

(75) Inventors: Gary A. Fisher, Kowloon Tong (HK); Fred Newcomb, Cetral (HK)

(73) Assignee: OneWorld Enterprises Limited, Kowloon Bay (HK)

( * ) Notice: Subject to any disclaimer, the term of this patent is extended or adjusted under 35 U.S.C. 154(b) by 343 days.

(21) Appl. No.: 10/096,985

(22) Filed: Mar. 12, 2002

(65) Prior Publication Data

US 2003/0176144 A1 Sep. 18, 2003

(51) Int. Cl.[7] ..... A63H 33/26; G09F 19/00

(52) U.S. Cl. ..... 446/129; 446/396; 40/661.01; 40/711; 335/306

(58) Field of Search ..... 446/129, 132, 446/137–140, 92, 325, 351, 131, 396, 230; 40/426, 427, 661.01, 711; 35/306

(56) References Cited

U.S. PATENT DOCUMENTS 2,693,788 A * 11/1954 Spartz ..... 211/69.1
3,196,566 A * 7/1965 Littlefield ..... 40/411
4,178,707 A 12/1979 Littlefield ..... 404/426
4,233,777 A 11/1980 Inoue ..... 46/238
4,486,729 A * 12/1984 Lee ..... 335/306
5,182,533 A 1/1993 Ritts ..... 335/306
5,589,721 A * 12/1996 Han et al. ..... 310/90.5
6,116,982 A 9/2000 Roman et al. ..... 446/131

* cited by examiner

*Primary Examiner*—Jacob K. Ackun
(74) *Attorney, Agent, or Firm*—Darby & Darby

(57) ABSTRACT

An asymmetric object, such as a lighter and ashtray, a clock and a base, a model airplane, etc has a base and the object levitates from the base. The base defines an interior space housing a base magnet. A support plate extends perpendicular to the base. The base also defines an interior space housing at least one base magnet. The base magnet is a permanent magnet having a north pole and a south pole. The lighter has an interior space, a base end, a levitating end, and a midpoint. The lighter has a conventional mechanism to create a flame. The lighter has at least one lighter magnet connected thereto. Lighter magnet is a permanent magnet having a north pole and a south pole and the lighter is selectively levitated from the base. Another group of levitated objects are selected from the group comprised of a toothbrush, hairbrush, comb, razor, lipstick, ruler, calculator, calendar, photograph frame, notepad and flashlight. These objects will be levitated from a base in substantially the same manner as the lighter is suspended above the ashtray.

73 Claims, 11 Drawing Sheets

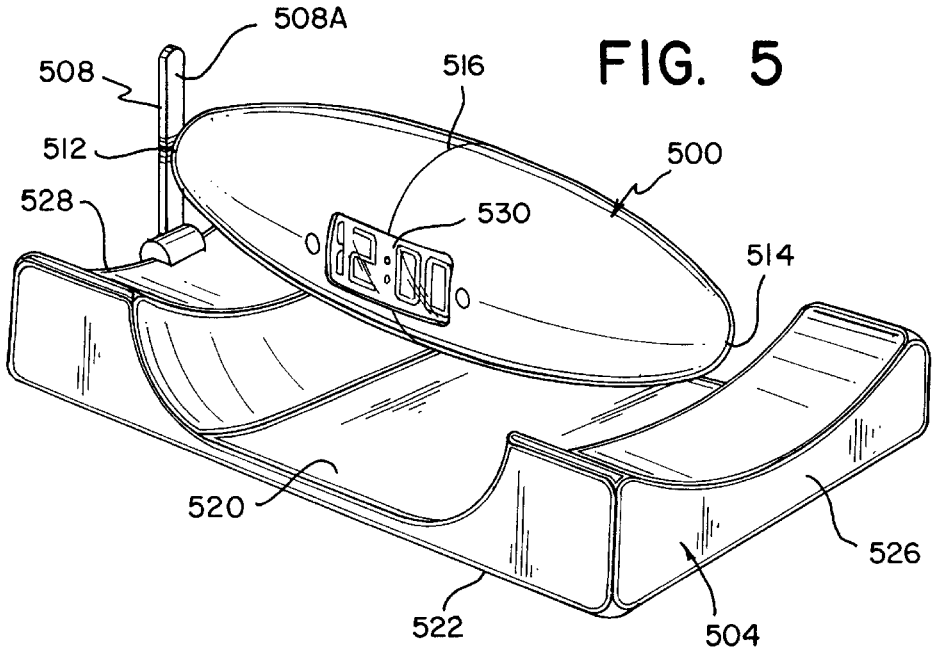
FIG. 5
FIG. 6
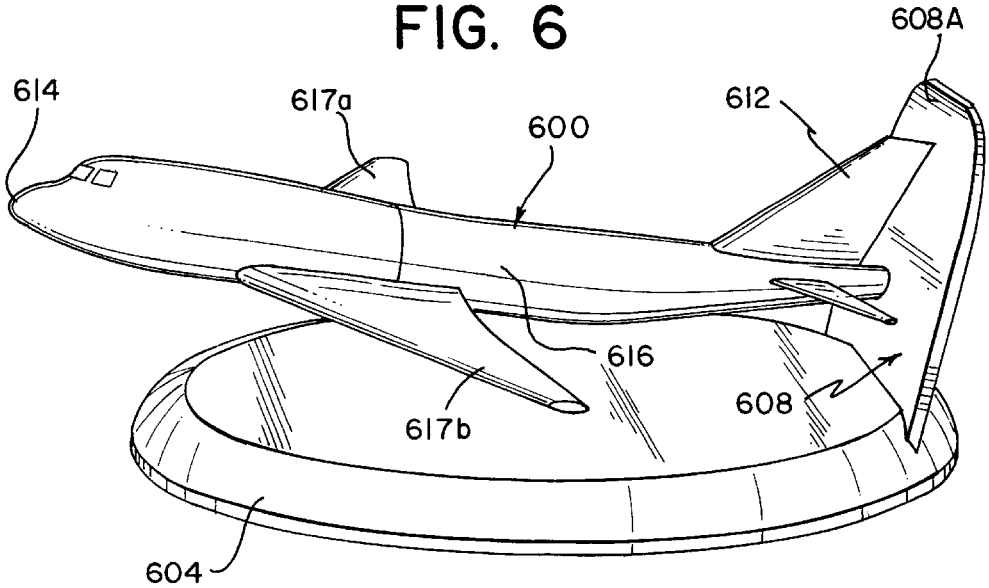

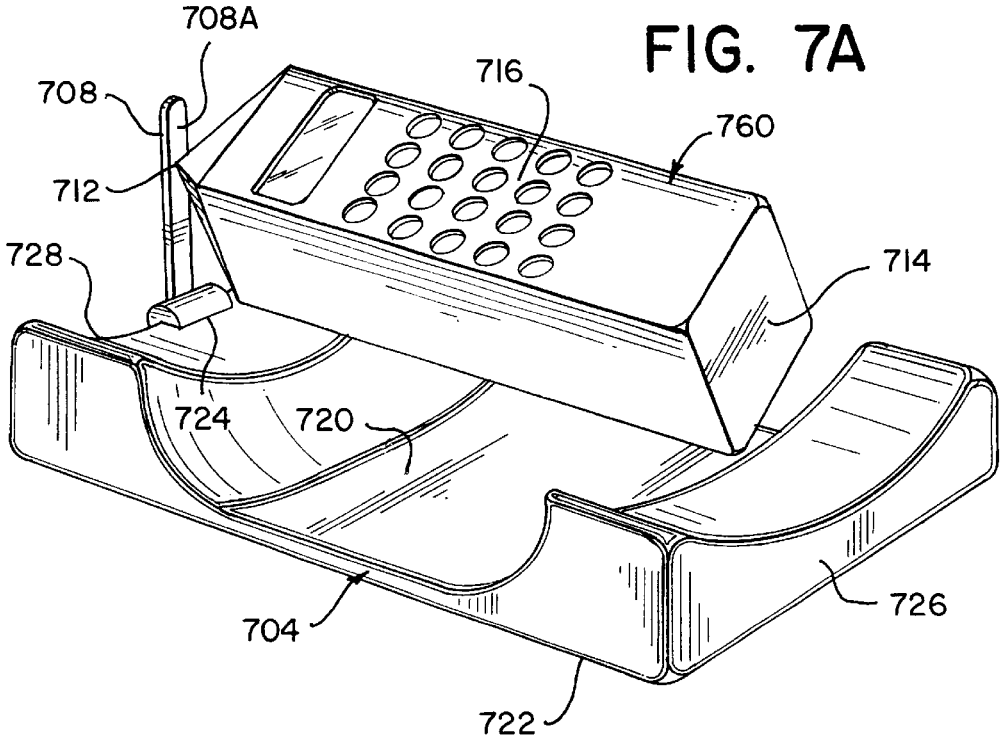
FIG. 7A
FIG. 7B
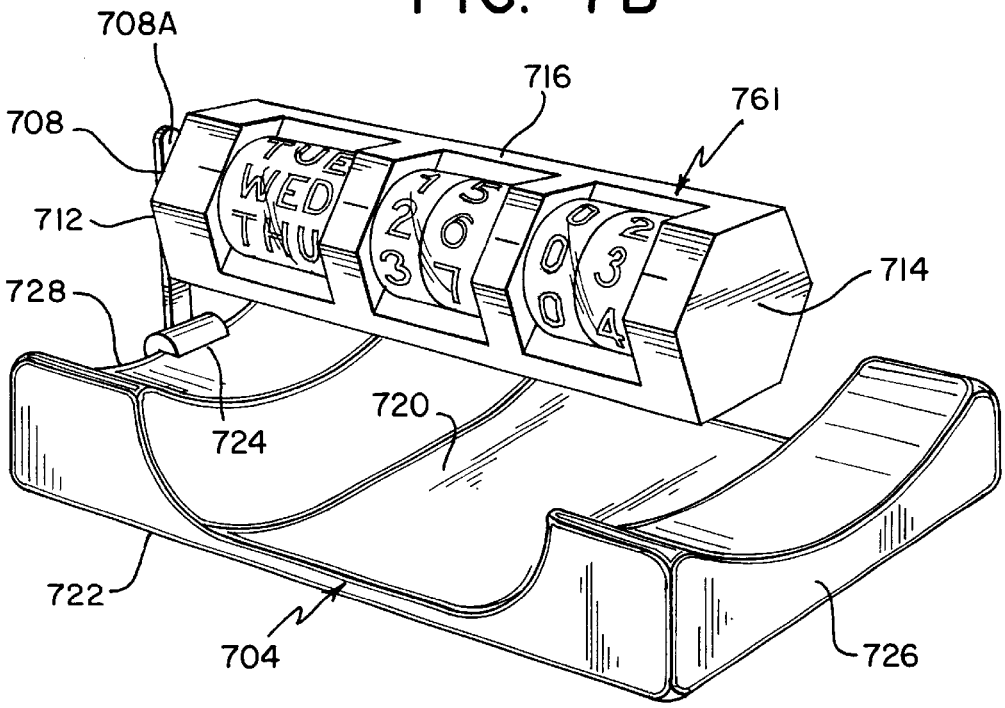

ASHTRAY WITH LEVITATING CIGARETTE LIGHTER AND OTHER OBJECTS

BACKGROUND OF THE INVENTION

1. Field of the Invention

The present invention relates to levitating objects using magnetic fields. More specifically, the present invention relates to levitating common objects above a specific base. These objects contain permanent magnets and are levitated over abase also containing permanent magnets.

2. Discussion of the Related Art

The principals of magnets and magnetic properties have been well known in the art for centuries. Most important of these properties is the knowledge that a magnet contains two (2) poles, one north (N) and one south (S). It is commonly known that opposite poles attract, i.e. N to S, and that the same poles repel (N to N, or S to S).

Common objects like cigarette lighters, clocks, model airplanes, toothbrushes, hairbrushes, combs, razors, lipsticks, rulers, calculators, photograph frames, calendars, note pads, and flashlights are also well known in their respective arts. However, all of these objects have one thing in common, they are all effected by gravity. Also, objects like cigarette lighters, toothbrushes, hairbrushes, combs, razors, lipsticks and rulers are typically light and thin objects. The size of these objects pose some problems. Most of these objects, in their typical embodiment, are simple to pick up for the average person. However, fine motor skills are required to pick the object up off a flat surface (i.e., a desk or sink). Some persons with physical disabilities have great difficulty with the common task of removing a light, small, flat or low aspect object from a flat surface. Some physically challenged persons do not possess the fine motor skills to accomplish these tasks. Specialized versions of most of the above objects, especially in the area of personal hygiene, are available to assist the physically challenged in utilizing these objects. Most other specialized versions increase the size or add extra grasping locations to ease grasping.

Other larger, heavier objects like clocks, calculators, notepads, flashlights and photograph frames require size to increase their visibility. The preferred location for all three objects are at a distance up off the surface they are resting on. This will increase their visibility and thus their utility to the owner. However, the current inventions need large housings to hold the objects up off the surface. These housings require extra material and molding steps to produce. These housings increase the weight and bulkiness of the object without any added function. Also, typically these objects can be produced rather inexpensively and the added housing only serves to increase the cost. Another difficulty with a clock occurs during its primary use, which is to awaken the user. Most users are disoriented upon being awakened and have difficulty with either small or heavy objects. This is a problem when a user is attempting to engage the alarm delay switch (a.k.a. the "snooze" button) or trying to pull the alarm clock closer to switch off the alarm. An object that is light and quick and easy to grasp will assist many a user in utilizing a clock to the fullest.

As for model airplanes, many people collect scale replicas of actual aircraft or photographs of the aircraft. A problem with scale models is that they can usually only be displayed in the "landed" position, that is with the landing gear down or if the landing gear is up, the aircraft is still resting on the surface. The benefit of photographs of actual aircraft is that the aircraft can be depicted in mid-flight. Viewing an aircraft in mid-flight affords the pleasure of viewing the object in its element and is usually preferred. A drawback with photographs are that they are not three-dimensional and are in a fixed setting. Thus, there is a need in the art for a device that can display a model (such as an airplane) in three-dimensions and in mid-flight.

U.S. Pat. No. 4,178,707 to Littlefield discloses a magnetically suspended model airplane. This invention tethers aircraft containing permanent magnets over a magnetic base to suspend the model aircraft. Because Littlefield's invention requires the airplane to be tethered, the aircraft is required to be set at a distance from the tether point. Thus, the size of the entire device is increased because the base must be larger to accommodate the length of the tether. Also, the tether fixes the model airplane to the base. Therefore, the tether must be permanently or firmly affixed to both the model and base. The attachment of the tether restricts the user from taking the model from the base to enjoy it at a closer distance. The tether also disturbs the aesthetics of the model airplane. Real aircraft do not have tethers. The models contained in the Littlefield device can never be a perfectly accurate model because of that limitation. The current invention requires no tethers and, thus, can be created to be a perfectly accurate scale model of any airplane.

A known invention is a pen suspended horizontally by magnetic fields using the principals similar to the current invention. However similar, there are still a number of distinctions from the levitating embodiments. First, the pen is small, light and symmetric across all three axises and essentially perfectly balanced at the midpoint. Thus, a suspended pen is extremely simple to manufacture, but vastly limits what objects can be suspended. Any non-symmetric product substituted for the pen would cause the device to fall out of balance and not be levitated properly. The current levitated embodiments of the claimed invention can be non-symmetric and can have a balance other than at the midpoint. Thus, the current invention can levitate more complex objects, due to the object's lack of symmetry and balance, because it discloses differing magnets of differing power.

Another known object is a pen disposed vertically from a clock by the use of magnetic forces. However, the clock is not suspended or levitating, it is held in place physically by an arm. This is completely different from any embodiment of the present invention, as described below. Next, the pen is disposed, not levitated. The pen in the illustration is positioned using simple magnetic attraction. This is in opposite to the complex magnetic interaction required to levitate all of the embodiments of the current invention. Plus, this object disposes the pen vertically, while the current invention levitates objects horizontally.

A third and fourth known object is a levitating photograph frame in the shape of a cube and a levitating globe of the earth. Both of these objects levitate the frame and globe between two opposed electromagnets with the frame or globe levitating between them. The use of electromagnets require the device to be powered. Also, the globe device requires the user's manual adjustment to achieve levitation of the object. In opposite, the current invention uses permanent magnets, no electric current is necessary. Thus, the current levitating embodiments are improvements over an electromagnetic invention. There is no power or user intervention required to levitate any of the below described embodied objects.

Thus, there is still a need in the art to levitate common objects off a flat surface. For small and light objects, levitating them in mid air will allow persons without fine motor skills or other physical challenges to pick them up and use the device. Also, other embodiments will allow for disposable items to be placed within a holder that will levitate. This will reduce the waste and loss of usefulness of the object. Objects such as razors, toothbrushes, and lipsticks have a limited span of use. An embodiment will allow for the item to be replaced so as not to dispose of the entire device once the item is expended. For heavier objects, the visibility of the object can be increased without the addition of a bulky and heavy housing. For a clock containing an alarm, levitating the clock can aid in the recently awakened user to either delay or shut off the alarm. By having the clock levitate, it may be easier for the user to grasp or pull the item close so as to utilize the controls thereof. For model aircraft; depicting the aircraft in flight and having a three dimensional model are both preferred ways of viewing the model. The ability to levitate the model aircraft combines both preferred versions of displaying a model aircraft.

SUMMARY OF THE INVENTION

It is the foregoing and various other drawbacks of the prior art which the present invention seeks to overcome by providing a lighter and an ashtray, a clock and a base, a model airplane or other asymmetric object having a base and an object that levitates from the base. A support plate extends perpendicular to the base. The base also defines an interior space housing at least one base magnet. The base magnet is a permanent magnet having a north pole and a south pole. The lighter has an interior space, a base end, a levitating end, and a midpoint. The lighter has a conventional mechanism to create a flame. The lighter has at least one lighter magnet connected thereto. The lighter magnet is a permanent magnet having a north pole and a south pole and the lighter is selectively levitated from the base.

Another group of levitated objects can be selected from the group comprised of a toothbrush, hairbrush, comb, razor, lipstick, ruler, calculator, photograph frame, calendar, note pad, and flashlight. These objects will be levitated from a base in substantially the same manner as the lighter is suspended above the ashtray.

BRIEF DESCRIPTION OF THE DRAWING FIGURES

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

FIG. 5 is a perspective view generally illustrating a clock of the present invention;

FIG. 6 is a perspective view generally illustrating a airplane of the present invention; and FIGS. 7A to 7K are perspective views generally illustrating some generic items of the present invention.

DETAILED DESCRIPTION OF THE PREFERRED EMBODIMENT

Figure 1A:
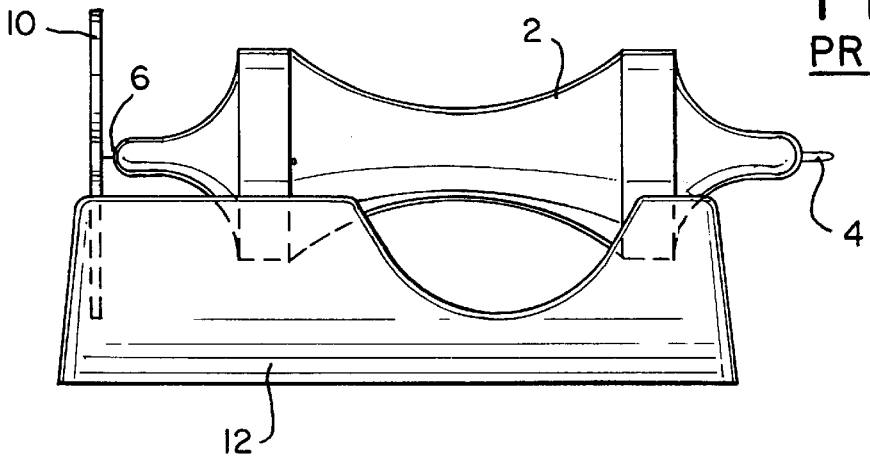
FIG. 1A PRIOR ART
FIGS. 1A and 1B are side and front views, respectfully, generally illustrating a prior art pen being levitated horizontally.
Figure 1B:
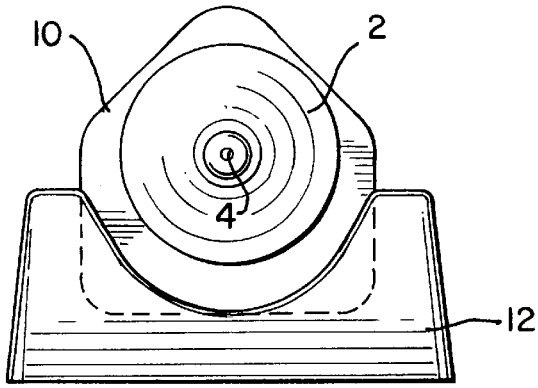
FIG. 1B PRIOR ART
Figure 2A:
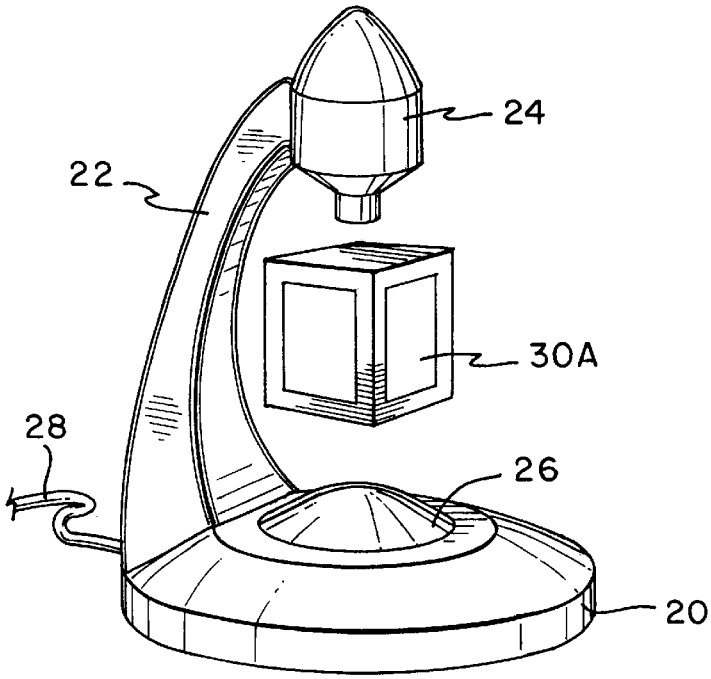
FIG. 2A PRIOR ART
FIGS. 2A and 2B are perspective views generally illustrating a prior art photograph frame and globe levitated by electromagnets.
Figure 2B:
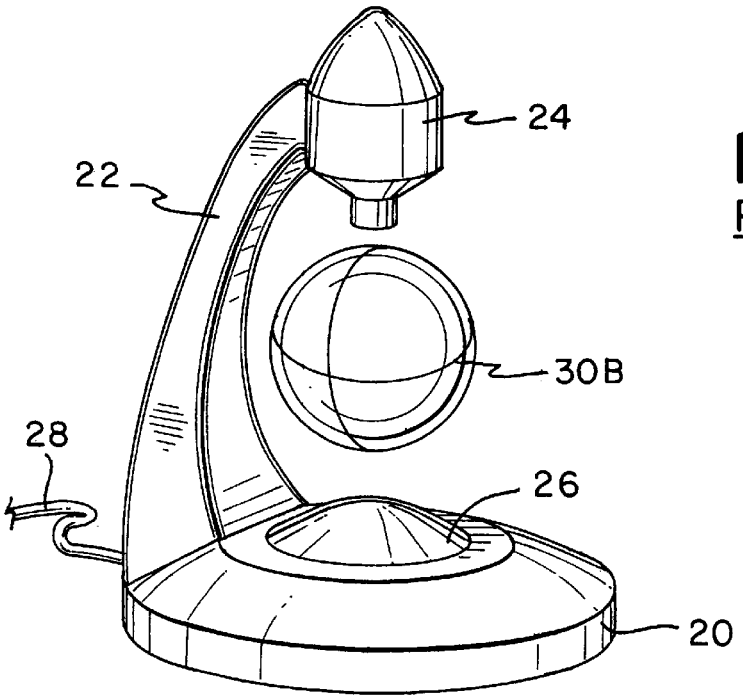
FIG. 2B PRIOR ART
Figure 3:
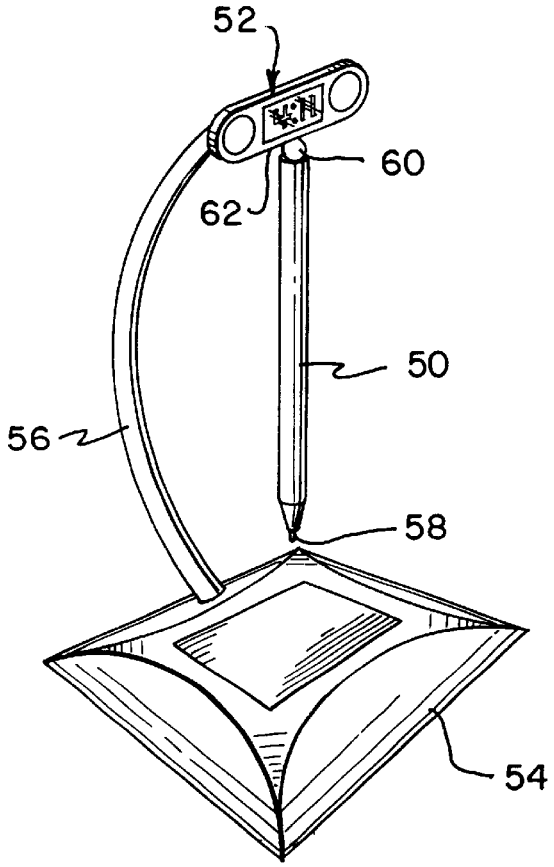
FIG. 3 PRIOR ART
FIG. 3 is a perspective view generally illustrating a prior art pen disposed vertically.
Figure 4A:
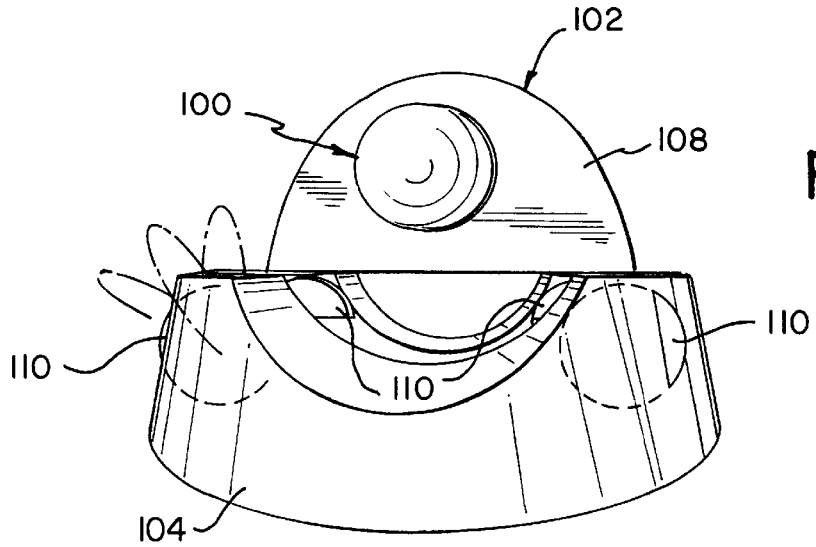
FIGS. 4A–4E are multiple views illustrating the lighter and ashtray.
Figure 4B:
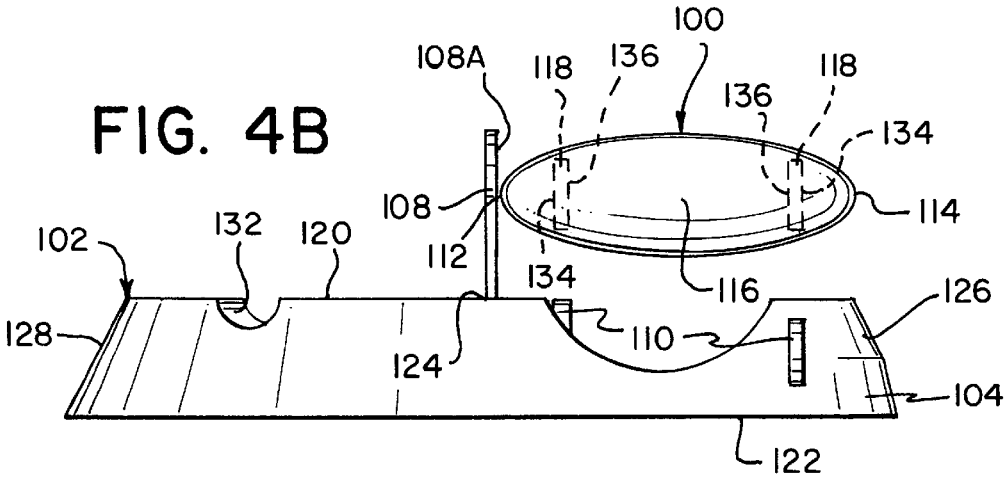
Figure 4C:
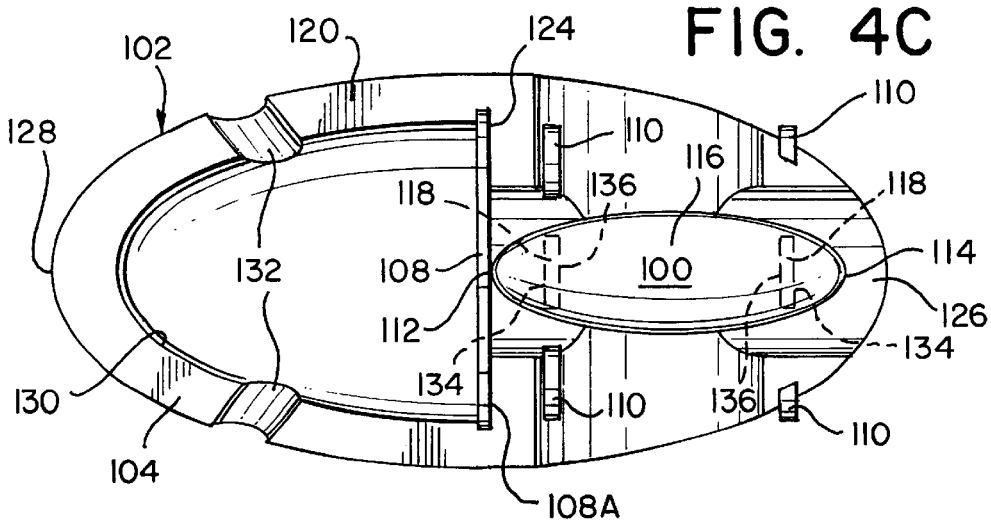
Figure 4D:
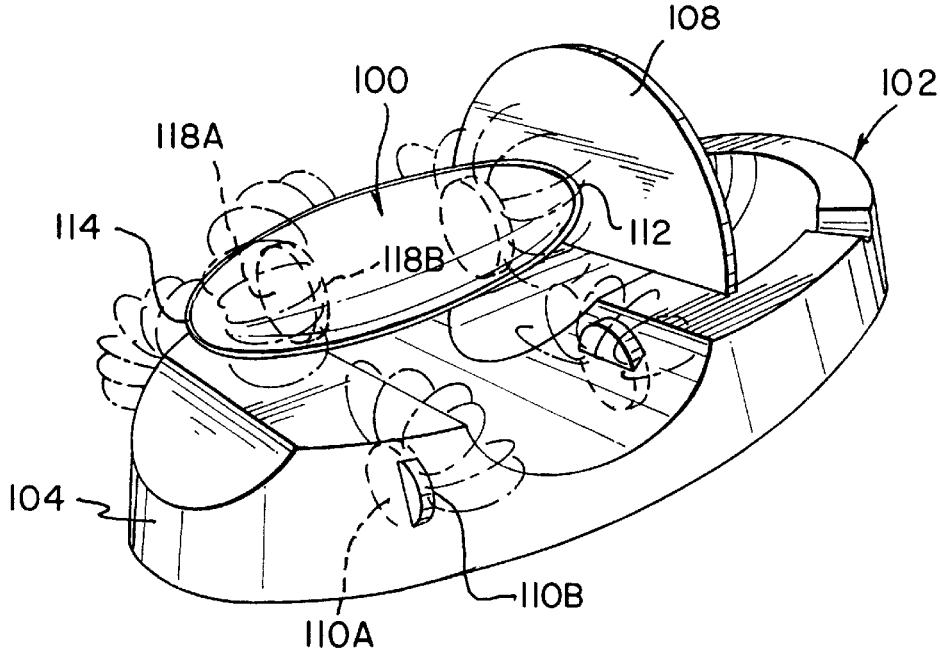
Figure 4E:
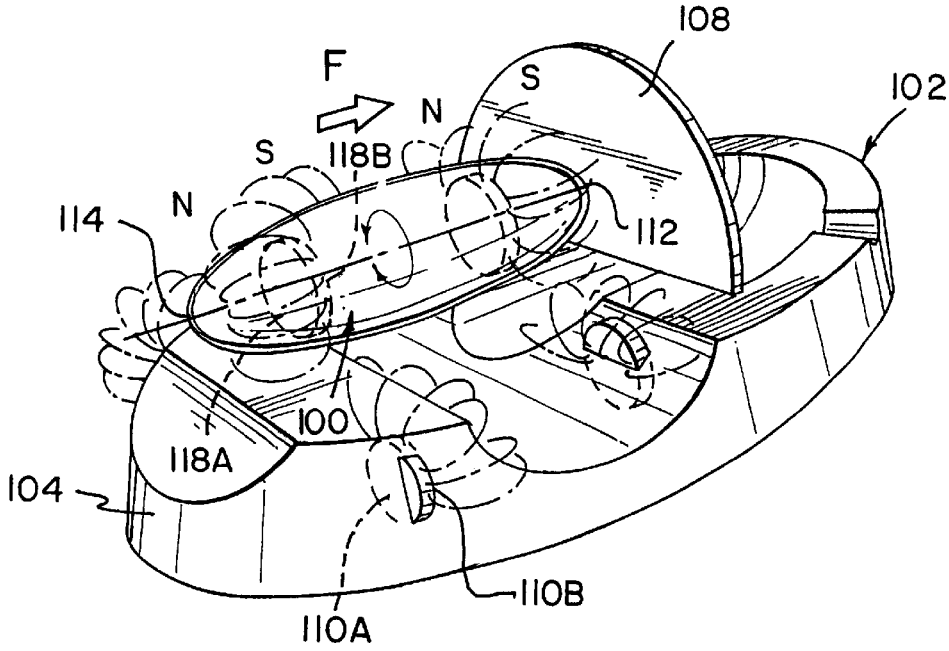

Referring now to FIGS. 1–3, prior art devices that use a magnetic field to assist in mounting an object are illustrated. FIGS. 1A and 1B are a side and end views, respectfully, illustrating a levitating pen 2 and a base 12. A symmetric pen 2 has an ink end 4 and a contact end 6. A contact plate 10 stands vertical from base 12. Contact end 6 is in physical contact with contact plate 10. Symmetrically powered magnets are disposed within the pen 2 and the base 12.

FIGS. 2A and 2B illustrate a cube-shaped or sphere-shaped item, respectfully, floating by the use of electromagnets that is currently being sold in "Lifestyle Fascination" and "Gifts You Never Knew Existed" catalogues, respectfully. A base 20 contains a support arm 22, a top electromagnet 24 and a bottom electromagnet 26. The base 20 also connects with an external electric power supply 28. Cube-shaped object 30A or sphere-shaped object 30B allegedly is floating between the top electromagnet 24 and the bottom electromagnet 26. Object 30A and 30B contains magnets (not illustrated) to allegedly magnetically float these objects 30A and 30B within an electromagnetic field.

FIG. 3 illustrates a prior art pen 50 that is currently being sold in "Lifestyle Fascination" catalogue. Pen 50 allegedly depends downwardly magnetically from a clock 52. Clock 52 is held up from a base 54 by an arm 56. Pen 50 has an ink end 58 and a magnetic end 60. Clock 52 has a magnetic bottom 62, which is in physical and magnetic contact with the magnetic end 60 of pen 50. According to the advertisement, this contact allows the pen 50 to depend vertically downwardly from clock 52.

Referring now to FIGS. 4A to 4E, a levitating lighter and ashtray in accordance with the present invention is illustrated. An ashtray 102 includes a base 104. Base 104 has an interior space (not illustrated). Base 104 is connected to a support plate 108, which extends perpendicularly with respect to base 104. Base 104 also contains at least one base magnet 110. Base magnet 110 is a permanent magnet having a north pole 110A and a south pole 110B.

A lighter 100 defines an interior space and has a base end 112, a levitating end 114, and a midpoint 116. Lighter 100 contains a conventional mechanism to create a flame (not illustrated). Lighter 100 contains at least one lighter magnet 118. The lighter magnet 118 is a permanent magnet having a north pole 118A and a south pole 118B. The lighter 100 is selectively levitated from the base 104 upon having the base end 112 properly positioned, manually or otherwise, against the support plate 108.

Base 104 is further comprised of a top surface 120, a bottom surface 122, a support plate connection point 124, a near end 126, and a far end 128. Base 104 is also comprised of a basin 130 for containing ashes. Basin 130 extends from the far end 128 of the base to the support plate connection point 124. Basin 130 is further comprised of one or more semi-circular arcuate-shaped cut-outs 132 in the top surface 120 for holding a cigarette or a cigar. Further, the support plate 108 is connected to the base 104 at the support plate connection point 124. The support plate 108 also has a contact face 108A. Base magnet 110 is located between the support plate connection point 124 and the near end 126.

Lighter magnet 118 is contained within the lighter 100 and can be shaped like a toroid, sphere and/or a disk. The lighter magnet 118 further comprises an outer edge 134 and an inner edge 136. To cause the lighter 100 to levitate, the lighter 100 is positioned above the base 104 between the near end 126 and the support plate connection point 124. This placement allows the base magnet 110 and the lighter magnet 118 to substantially align with each other. When the base magnet 110 and the lighter magnet 118 are aligned, the lighter 100 will levitate. When levitating, the base end 112 of the lighter 100 will be in contact with the support plate contact face 108A at the proper position discussed above. Because the magnets 110, 118 have been pre-aligned, the user will find it quite intuitive as to where to place the lighter with respect to the base, including the support plate contact face.

In one embodiment of the lighter 100 and ashtray 102, in accordance with the present invention, base magnet 110 and lighter magnet 118 are of a predetermined strength. This strength determination allows the lighter 100 to levitate substantially parallel and at a predetermined distance from the top surface 120 of the base 104.

In a currently preferred exemplary embodiment, base 104 contains more then one base magnet 110. In accordance with this embodiment, the base magnets 110 are spaced apart from each other, but are still within the area defined by the support plate connection point 124 and the near end 126. Consistent with the base 104 containing multiple magnets, the lighter 100 can contain more then one lighter magnet 118. Both the base magnet 110 and the lighter magnet 118 are preferably disk-shaped. The lighter magnets 118 will also be spaced apart from each other but still within the interior 106 of the lighter 100.

All the above embodiments can incorporate a lighter 100 that is balanced about its midpoint 116 or not balanced about its midpoint 116. If the lighter 100 is not balanced about its midpoint 116 or is asymmetrically weighted, the lighter magnets 118 and the base magnets 110 must vary in strength to compensate for the imbalance in the lighter. This variation in strength will allow the lighter 100 to levitate substantially parallel to the top surface 120 of the base 104.

Inherent in all embodiments is one of two configurations. Both configurations align the like poles of the base magnet 110 and the lighter magnet 118. One is that the base magnet north pole 110A is directed toward the top surface 120 and the lighter magnet north pole 118A is disposed on the outer edge 114. The other is that the base magnet south pole 110B is directed toward the top surface 120 and the lighter magnet south pole 118B is disposed on the outer edge 114.

The above description related to a lighter 100 and a base 104. Other embodiments can include replacing the lighter 100 with a clock, model airplane, or other asymmetric weighted object. Further, any of the above objects will use the same magnetic principals as described above to levitate that object.

Referring now to FIG. 5, a levitating clock and a base in accordance with the present invention are illustrated. A base 504 defines an interior space (not illustrated) and has a support plate 508 extending perpendicular with respect to the base 504. Base 504 also contains at least one base magnet (not illustrated). The base magnet is a permanent magnet that has a north pole and a south pole.

A clock 500 defines an interior space and has a base end 512, a levitating end 514, and a midpoint 516. The clock 500 contains a device for telling time 530, e.g. an analog or digital display. The clock 500 contains at least one clock magnet (not illustrated). The clock magnet is a permanent magnet having a north pole and a south pole. The clock 500 is selectively levitated from the base 504 upon having the base end 512 properly positioned, manually or otherwise, against the support plate 508.

The base 504 is further comprised of a top surface 520, a bottom surface 522, a near end 526, and a far end 528. Support plate 508 has a contact face 508A. The base magnets can be located anywhere between the near end 526 and the far end 528. Also, the base magnets can be curved concave to the top surface 520 of the base 504, and the top surface 520 can be shaped to match the curvature of the base magnet.

The clock magnet may be shaped like a toroid, sphere and/or disk and is disposed within the clock 500. The clock magnet further comprises an outer edge and an inner edge. To cause the clock 500 to levitate, the clock 500 is positioned above the base 504. This placement allows the base magnet and the clock magnet to substantially align with each other. When the base magnet and the clock magnet are aligned, the clock 500 will levitate. When levitating, the base end 512 of the clock 500 may be in contact with the support plate contact face 508A at the proper position discussed above. Because the magnets have been pre-aligned, the user will find it quite intuitive as to where to place the clock 500 with respect to the base 504, including the support plate contact face 508A.

In one embodiment of the clock 500 and the base 504 in accordance with the present invention, the base magnet and the clock magnet are of a predetermined strength allowing the clock 500 to levitate substantially parallel and at a predetermined distance from the top surface 520 of the base 504.

In a currently preferred exemplary embodiment, the base 504 contains more then one base magnet. In accordance with this embodiment, the base magnets are spaced apart from each other, but still within the area defined by the near end 526 and the far end 528. Consistent with the base 504 containing multiple magnets, the clock 500 can contain more then one clock magnet. The multiple clock magnets maybe spaced apart from each other, but still within the interior of the clock 500.

All of the above embodiments can incorporate a clock 500 that is balanced about its midpoint 516 or not be balanced about its midpoint 516 or asymmetrically weighted. If the clock is imbalanced, clock magnets and the base magnets may vary in strength to allow the clock 500 to levitate substantially parallel to the top surface 520 of the base 504.

Inherent in all embodiments is one of two configurations. Both configuration align like poles of the base magnet and the clock magnet. One embodiment is that the base magnet north pole is directed toward the top surface 520 and the clock magnet north pole is disposed on the outer edge. The other is that the base magnet south pole is directed toward the top surface 520, and the clock magnet south pole is disposed on the outer edge.

Another embodiment may be that the clock 500 further comprises a device for sounding an alarm (not illustrated) at a predetermined time and the alarm is contained within the clock 500. Also, the base 504 can comprise a device for sounding an alarm at a predetermined time and the alarm is contained within the base 504. Another variation is that the clock 500 or the base 504 further comprises a device to stop sounding the alarm when the clock 500 is removed from the base 504.

Referring now to FIG. 6, a levitating model airplane in accordance with the present invention is illustrated. A base 604 has an interior space (not illustrated). Base 604 is connected to a support plate 608, which extends perpendicularly with respect to base 604. Base 604 also contains at least one base magnet (not illustrated), which is a permanent magnet having a north pole and a south pole.

A model airplane 600 defines an interior space and has a tail end 612, a nose end 614, a midpoint 616, a left wing 617*a* and a right wing 617*b*. Model Airplane 600 contains at least one model airplane magnet (not illustrated), which is a permanent magnet having a north pole and a south pole. The model airplane 600 is selectively levitated from the base 604 upon having tail end 612 being properly positioned, manually or otherwise, against the support plate 608.

Model airplane magnet is contained within the model airplane 600 and can be shaped like a toroid, sphere and/or a disk. The model airplane magnet further comprises an outer edge and an inner edge. To cause the model airplane 600 to levitate, the model airplane 600 is positioned above the base 604. This placement allows the base magnet and the model airplane magnet to substantially align with each other. When the base magnet and the model airplane magnet are aligned, the model airplane 600 will levitate. When levitating, the tail end 612 of the model airplane 600 will be in contact with the support plate contact face 608A at the proper position discussed above. Because the magnets have been pre-aligned, the user will find it quite intuitive as to where to place the lighter with respect to the base, including the support plate contact face.

In one embodiment of the model airplane 600 and base 604, in accordance with the present invention, base magnet and model airplane magnet are of a predetermined strength. This strength determination allows the model airplane 600 to levitate substantially parallel and at a predetermined distance from the base 604.

In a currently preferred exemplary embodiment, base 604 contains more then one base magnet. In accordance with this embodiment, the base magnets are spaced apart from each other. Consistent with the base 604 containing multiple magnets, the model airplane 600 can contain more then one model airplane magnet. Both the base magnet and the model airplane magnet are preferably disk-shaped. The model airplane magnets will also be spaced apart from each other, but still within the model airplane 600.

All the above embodiments can incorporate a model airplane 600 that is balanced about its midpoint 616 or not balanced about its midpoint 616. If the model airplane 600 is not balanced about its midpoint 616 or is asymmetrically weighted, the model airplane magnets and the base magnets must vary in strength to compensate for the imbalance in the model airplane. Also, magnets can be placed at either or both the left wing 617*a* or the right wing 617*b* to compensate for the imbalance. These variation in both strength and location will allow the model airplane 600 to levitate substantially parallel to the base 604.

Figure 7C:
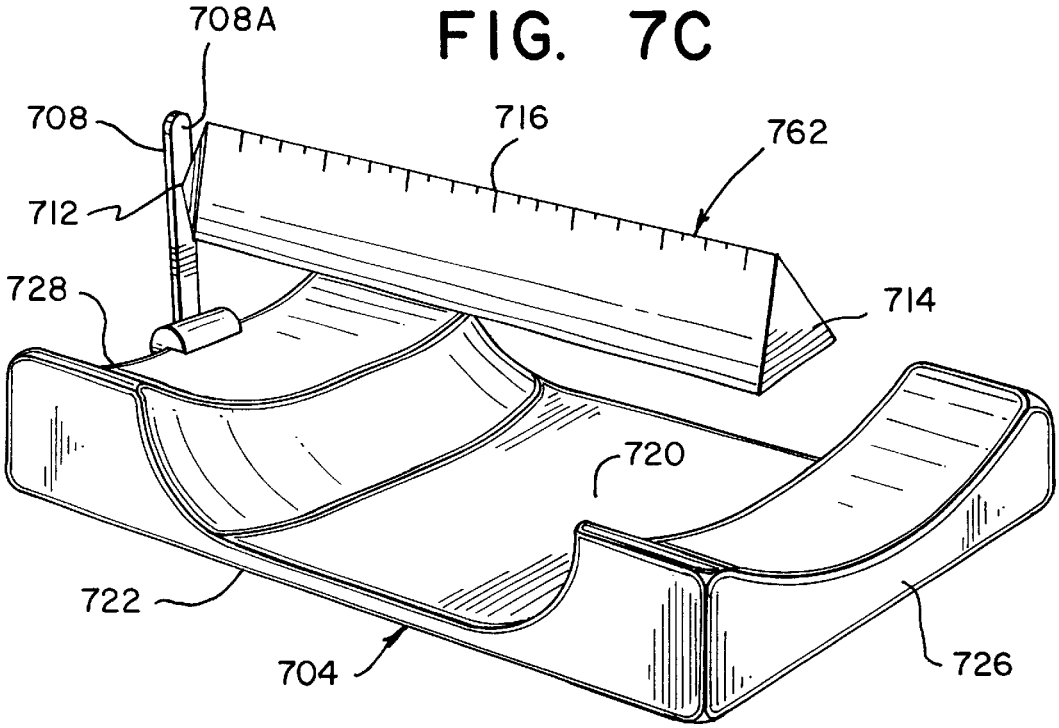
Figure 7D:
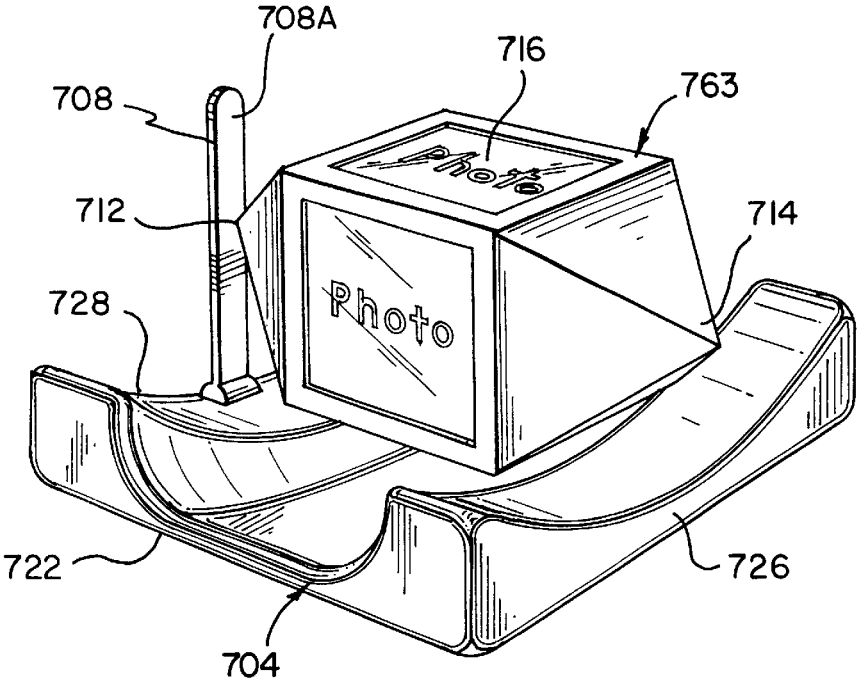
Figure 7E:
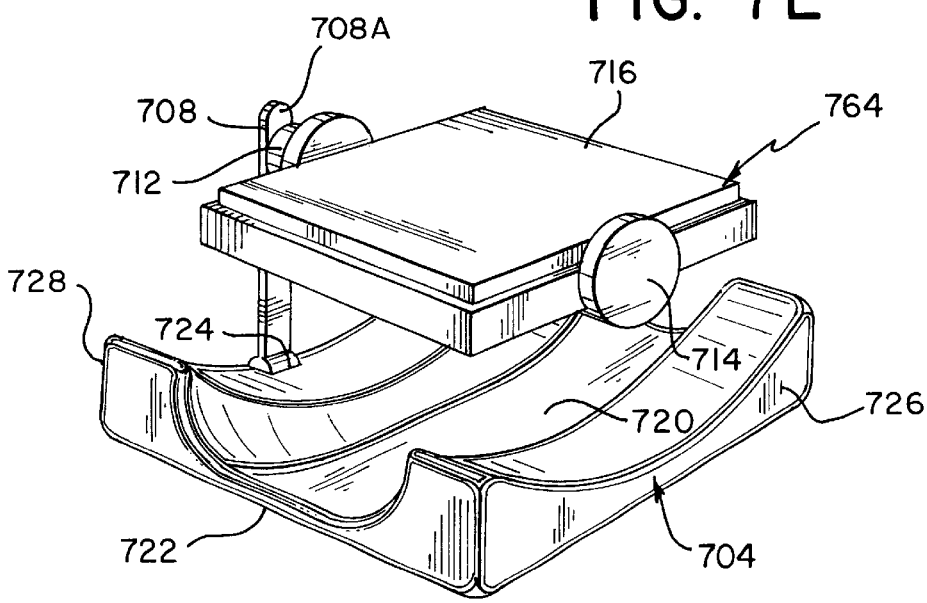
Figure 7F:
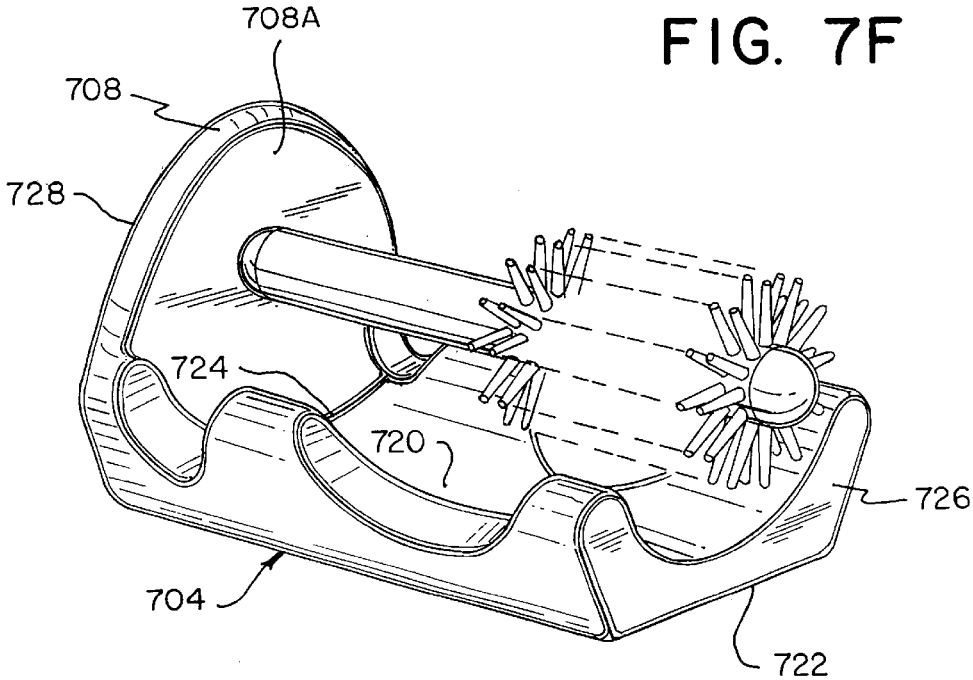
Figure 7G:
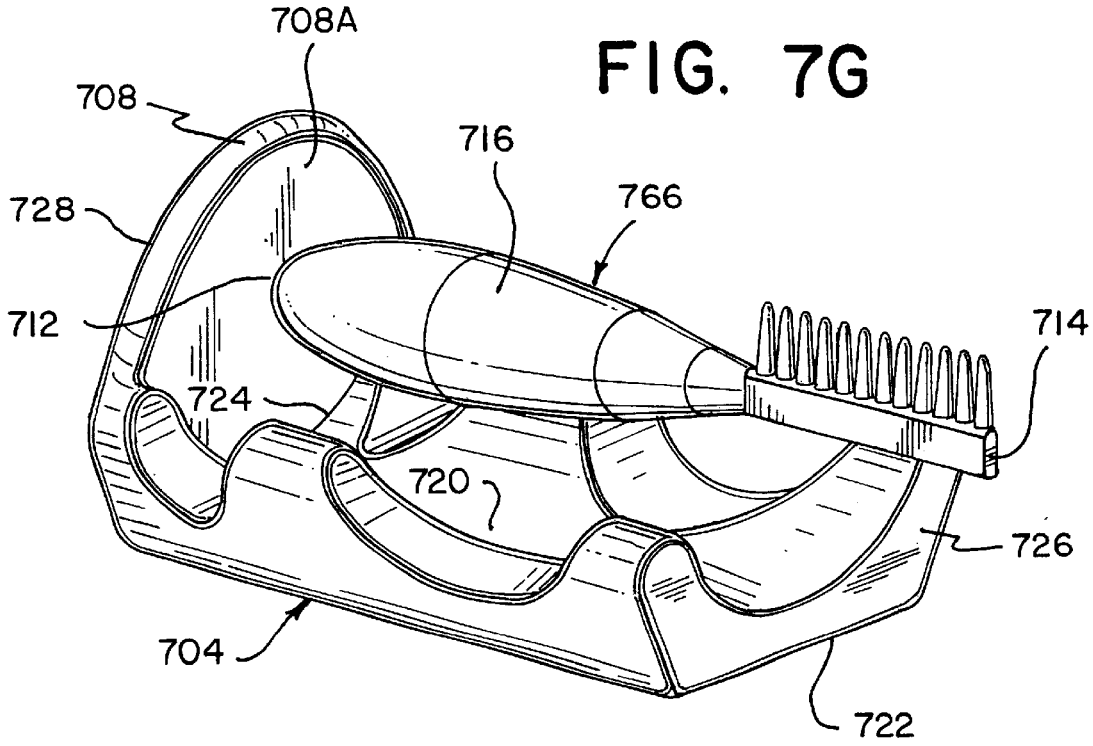
Figure 7H:
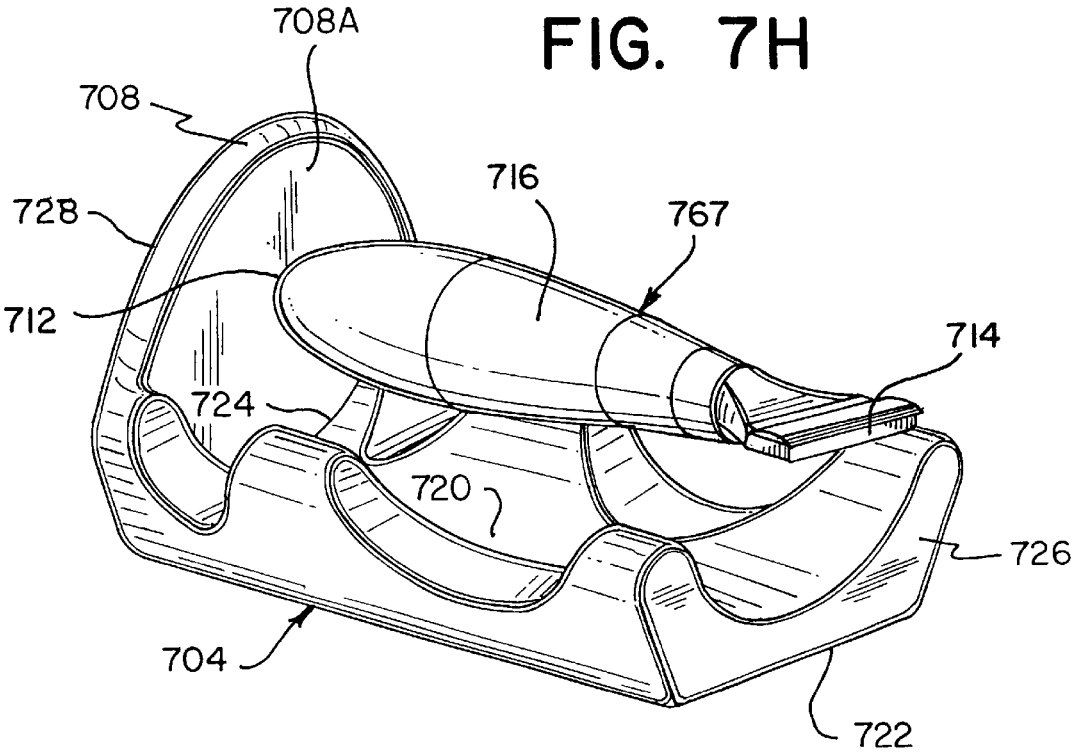
Figure 7I:
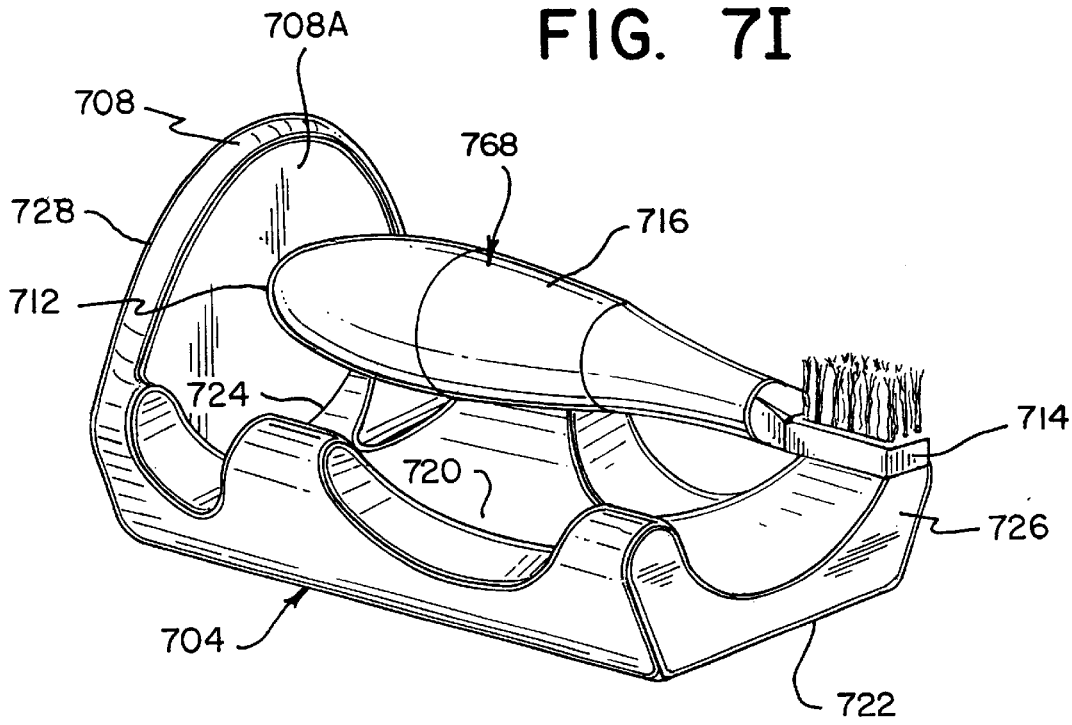
Figure 7J:
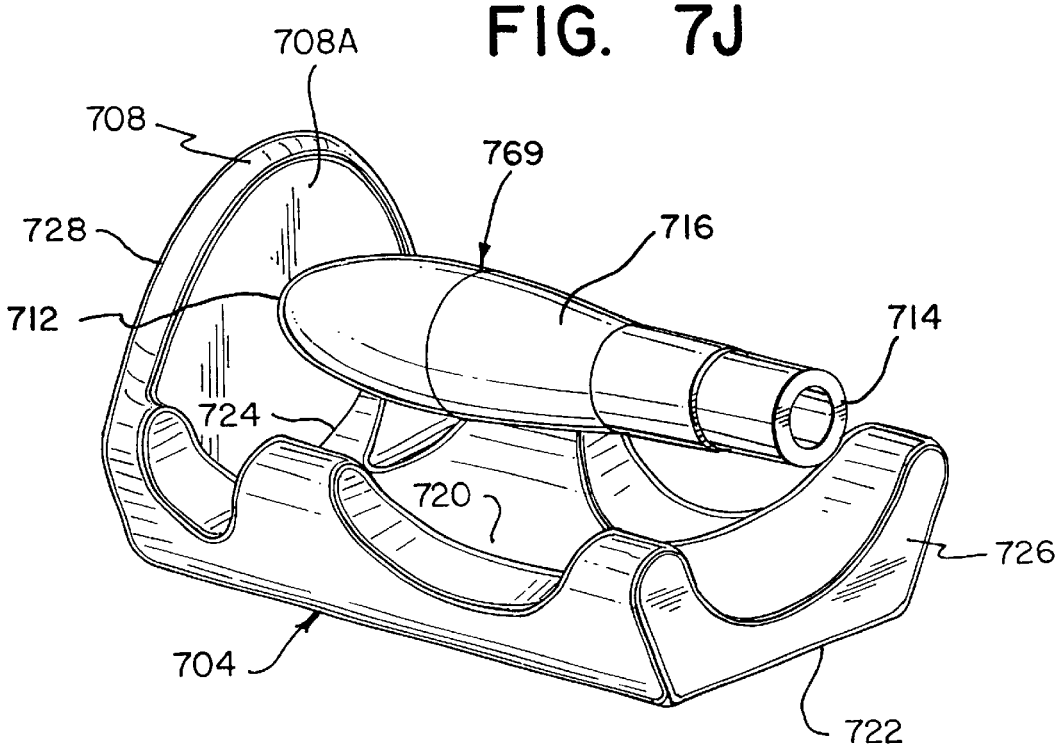
Figure 7K:
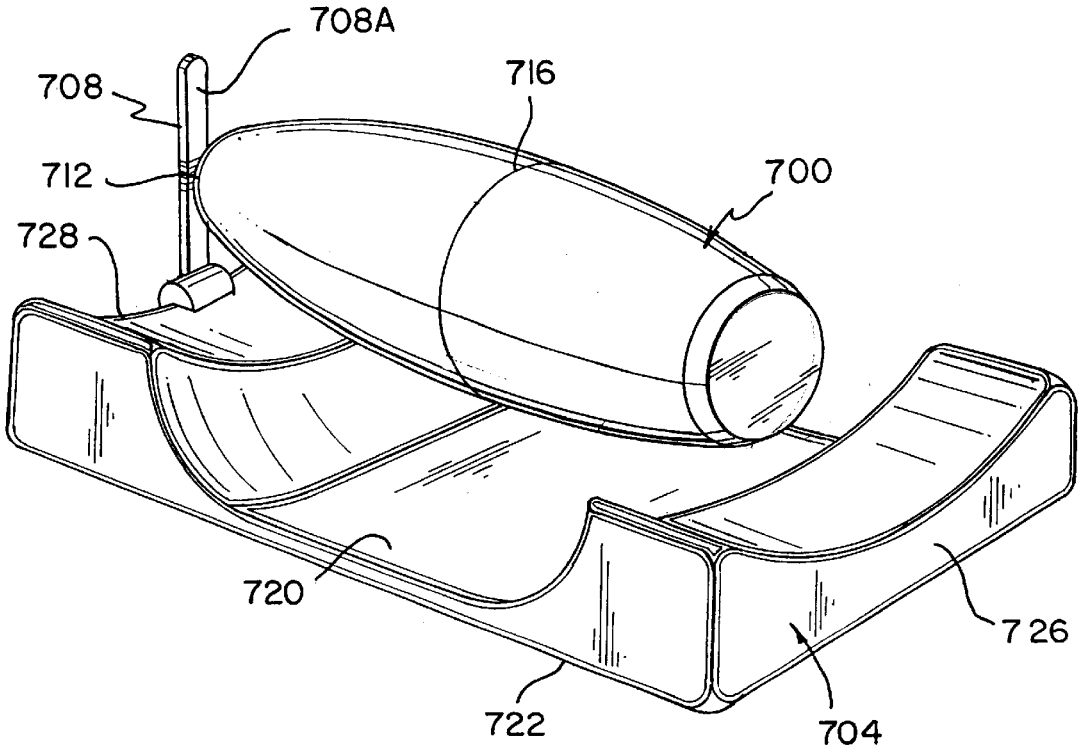

Referring now to FIGS. 7A to 7K, levitating generic items include a calculator, FIG. 7A, a calendar, FIG. 7B, a ruler, FIG. 7C, a photograph frame, FIG. 7D, a note pad, FIG. 7E, a hairbrush, FIG. 7F, a comb, FIG. 7G and a flashlight, FIG. 7K. Also, generic disposable items include a razor, FIG. 7H, a toothbrush, FIG. 7I, and a lipstick, FIG. 7J. All items have a levitated object 700 and base 704. The base 704 defines an interior space. A support plate 708 extends perpendicular to the base 704. The base 704 contains at least one base magnet (not illustrated). The base magnet is a permanent magnet having a north pole and a south pole.

The levitated object can be a calculator 760, calendar 761, ruler 762, photograph frame 763, note pad 764, hairbrush 765, comb 766, razor 767, toothbrush 768, lipstick 769, or flashlight 770. The levitated object defines an interior space (not illustrated) and has abase end 712, levitated end 714 and a midpoint 716. Every levitated object has at least one levitated object magnet (not illustrated) connected to it. The levitated object magnet is a permanent magnet having a north pole and a south pole, and the levitated object is selectively levitated from the base 704.

The base 704 further includes a top surface 720, a bottom surface 722, a support plate connection point 724, a near end 726, and a far end 728. The support plate 708 is connected to the base at the support plate connection point 724, and the support plate 708 has a contact face 708A. In one embodiment, the base magnet can be curved concave to the top surface 720 of the base 704 with the top surface 720 being shaped to match the curvature of the base magnet.

The levitated object magnet can be shaped like a toroid, sphere or disk and is disposed within the levitated object. To levitate, the levitated object may be positioned above the base 704, so that the base magnet and levitated object magnet are substantially aligned with each other. In this position, the base end 712 of the levitated object is in contact with the support plate contact face 708A and when the base magnet and the levitated object magnet are aligned, so the levitated object will levitate.

The base magnet and the levitated object magnet are of a predetermined strength, which allows the levitated object to levitate substantially parallel and at a predetermined distance from the top surface 720 of the base 704. The base 704 may also contain more than one base magnet, and the base magnets are spaced apart from each other, but still within the area defined by the base 704. Also, the levitated object can contain more then one levitated object magnet. The levitated object magnets can be spaced apart from each other, but still within the interior of the levitated object.

All the above embodiments can incorporate a levitated object that is balanced about its midpoint 716 or not balanced about its midpoint 716. If the levitated object is not balanced about its midpoint 716 or is asymmetrically weighted, the levitated object magnets and the base magnets must vary in strength to compensate for the imbalance in the lighter. This variation in strength will allow the levitated object 700 to levitate substantially parallel to the top surface 720 of the base 704.

Inherent in all embodiments is one of two configurations. Both configurations align the like poles of the base magnet and the levitated object magnet. One is that the base magnet north pole is directed toward the top surface 720 and the levitated object magnet north pole is disposed on the outer edge. The other is that the base magnet south pole is directed toward the top surface 720 and the lighter magnet south pole is disposed on the outer edge.

Another embodiment includes that the levitated object may contain a disposable razor, toothbrush or lipstick within an interior space and the disposable razor, toothbrush or lipstick can be inserted and removed from the interior space.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

What is claimed is:

1. A lighter and ashtray comprising:

a base defining an interior space;

a support plate extending perpendicular to said base;

at least one base magnet, said base magnet being a permanent magnet having a north pole and a south pole;

a lighter defining an interior space, having a base end, a levitating end, and a midpoint, said lighter having a means to create a flame; and at least one lighter magnet connected to said lighter, said lighter magnet being a permanent magnet having a north pole and a south pole, and said lighter being selectively levitated from said base.

2. A lighter and ashtray as defined in claim 1, wherein said base is further comprised of a top surface, a bottom surface, a support plate connection point, a near end, and a far end.

3. A lighter and ashtray as defined in claim 2, wherein said base comprises a basin for containing ashes, said basin extends from said far end of said base to said support plate connection point.

4. A lighter and ashtray as defined in claim 3, wherein said basin further comprises one or more semi-circular arcs cut into the top surface for holding a cigarette or a cigar.

5. A lighter and ashtray as defined in claim 4, wherein said support plate is connected to said base at said support plate connection point, said support plate has a contact face.

6. A lighter and ashtray as defined in claim 5, wherein said base magnet is located between said support plate connection point and said near end.

7. A lighter and ashtray as defined in claim 2, wherein said base magnet is curved concave to said top surface of said base, said top surface being shaped to match the curvature of said base magnet.

8. A lighter and ashtray as defined in claim 6, wherein said lighter magnet is shaped from the group consisting of: toroid, sphere and disk.

9. A lighter and ashtray as defined in claim 8, wherein said lighter magnet further comprises an outer edge and an inner edge.

10. A lighter and ashtray as defined in claim 9, wherein said lighter magnet is disposed with in said lighter.

11. A lighter and ashtray as defined in claim 10, wherein said lighter is positioned:

above said base, between said near end and said support plate connection point so said base magnet and said lighter magnet are substantially aligned with each other, and said base end of said lighter is in contact with said support plate contact face when said base magnet and said lighter magnet are aligned so said lighter will levitate.

12. A lighter and ashtray as defined in claim 11, wherein said base magnet and said lighter magnet are of a predetermined strength allowing said lighter to levitate substantially parallel and at a predetermined distance from said top surface of said base.

13. A lighter and ashtray as defined in claim 12, wherein said base contains more then one base magnet, said base magnets are spaced apart from each other but still within the area defined by said support plate connection point and said near end.

14. A lighter and ashtray as defined in claim 13, wherein said lighter contains more then one lighter magnet, said lighter magnets are spaced apart from each other, but still within said interior of said lighter.

15. A lighter and ashtray as defined in claim 14, wherein said lighter is balanced about its midpoint.

16. A lighter and ashtray as defined in claim 14, wherein said lighter is not balanced about its midpoint, said lighter magnets and said base magnets vary in strength to allow said lighter to levitate substantially parallel to said top surface of said base.

17. A lighter and ashtray as defined in claim 12, wherein said base magnet north pole is directed toward said top surface and said lighter magnet north pole is disposed on said outer edge.

18. A lighter and ashtray as defined in claim 12, wherein said base magnet south pole is directed toward said top surface, and said lighter magnet south pole is disposed on said outer edge.

19. A clock and base comprising:

a base defining an interior space;

a support plate extending perpendicular to said base;

at least one base magnet, said base magnet being a permanent magnet having a north pole and a south pole;

a clock defining an interior space, having a base end, a levitating end, and a midpoint, said clock containing a means to tell time; and at least one clock magnet connected to said clock, said clock magnet being a permanent magnet having a north pole and a south pole, and said clock being selectively levitated from said base.

20. A clock and base as defined in claim 19, wherein said base is further comprised of a top surface, a bottom surface, a support plate connection point, a near end, and a far end.

21. A clock and base as defined in claim 20, wherein said support plate is connected to said base at said support plate connection point, said support plate has a contact face.

22. A clock and base as defined in claim 21, wherein said base magnet is located between said support plate connection point and said near end.

23. A clock and base as defined in claim 20, wherein said base magnet is curved concave to said top surface of said base, said top surface being shaped to match the curvature of said base magnet.

24. A clock and base as defined in claim 22, wherein said clock magnet is shaped from the group consisting of: toroid, sphere and disk.

25. A clock and base as defined in claim 24, wherein said clock magnet further comprises an outer edge and an inner edge.

26. A clock and base as defined in claim 25, wherein said clock magnet is disposed within said clock.

27. A clock and base as defined in claim 26, wherein said clock is positioned:

above said base, between said near end and said support plate connection point so said base magnet and said clock magnet are substantially aligned with each other, and said base end of said clock is in contact with said support plate contact face when said base magnet and said clock magnet are aligned so said clock will levitate.

28. A clock and base as defined in claim 27, wherein said base magnet and said clock magnet are of a predetermined strength allowing said clock to levitate substantially parallel and at a predetermined distance from said top surface of said base.

29. A clock and base as defined in claim 28, wherein said base contains more then one base magnet, said base magnets are spaced apart from each other but still within the area defined by said support plate connection point and said near end.

30. A clock and base as defined in claim 29, wherein said clock contains more then one clock magnet, said clock magnets are spaced apart from each other, but still within said interior of said clock.

31. A clock and base as defined in claim 30, wherein said clock is balanced about its midpoint.

32. A clock and base as defined in claim 30, wherein said clock is not balanced about its midpoint, said clock magnets and said base magnets vary in strength to allow said clock to levitate substantially parallel to said top surface of said base.

33. A clock and base as defined in claim 28, wherein said base magnet north pole being directed toward said top surface and said clock magnet north pole is disposed on said outer edge.

34. A clock and base as defined in claim 28, wherein said base magnet south pole being directed toward said top surface, and said clock magnet south pole is disposed on said outer edge.

35. A clock and base as defined in claim 28, wherein said clock further comprises a means to sound an alarm at a predetermined time, said alarm is contained within said clock.

36. A clock and base as defined in claim 28, wherein said base further comprises a means to sound an alarm at a predetermined time, said alarm is contained within said base.

37. A clock and base as defined in claim 35, wherein said clock further comprises a means to stop the sounding of said alarm when said clock is removed from said base.

38. A clock and base as defined in claim 36, wherein said base further comprises a means to stop the sounding of said alarm when said clock is removed from said base.

39. A model airplane and base comprising:

a base defining an interior space;

a support plate extending perpendicular to said base;

at least one base magnet, said base magnet being a permanent magnet having a north pole and a south pole;

a model airplane defining an interior space, having a nose end, a tail end, left wing, right wing and a midpoint; and at least one model airplane magnet connected to said model airplane, said model airplane magnet being a permanent magnet having a north pole and a south pole, and said model airplane being selectively levitated from said base.

40. A model airplane and base as defined in claim 39, wherein said base is further comprised of a top surface, a bottom surface, a support plate connection point, a near end, and a far end.

41. A model airplane and base as defined in claim 40, wherein said support plate is connected to said base at said support plate connection point, said support plate has a contact face.

42. A model airplane and base as defined in claim 41, wherein said base magnet is located between said support plate connection point and said near end.

43. A model airplane and base as defined in claim 40, wherein said base magnet is curved concave to said top surface of said base, said top surface being shaped to match the curvature of said base magnet.

44. A model airplane and base as defined in claim 42, wherein said model airplane magnet is shaped from the group consisting of: toroid, sphere and disk.

45. A model airplane and base as defined in claim 44, wherein said model airplane magnet further comprises an outer edge and an inner edge.

46. A model airplane and base as defined in claim 45, wherein said model airplane magnet is disposed within said model airplane.

47. A model airplane and base as defined in claim 46, wherein said model airplane is positioned:

above said base, between said near end and said support plate connection point so said base magnet and said model airplane magnet are substantially aligned with each other, and said base end of said model airplane is in contact with said support plate contact face when said base magnet and said model airplane magnet are aligned so said model airplane will levitate.

48. A model airplane and base as defined in claim 47, wherein said base magnet and said model airplane magnet are of a predetermined strength allowing said model airplane to levitate substantially parallel and at a predetermined distance from said top surface of said base.

49. A model airplane and base as defined in claim 48, wherein said base contains more then one base magnet, said base magnets are spaced apart from each other but still within the area defined by said support plate connection point and said near end.

50. A model airplane and base as defined in claim 49, wherein said model airplane contains more then one model airplane magnet, said model airplane magnets are spaced apart from each other, but still within said interior of said model airplane in; said nose end, said tail end, said left wing or said right wing.

51. A model airplane and base as defined in claim 50, wherein said model airplane is balanced about its midpoint.

52. A model airplane and base as defined in claim 50, wherein said model airplane is not balanced about its midpoint, said model airplane magnets and said base magnets vary in strength to allow said model airplane to levitate substantially parallel to said top surface of said base.

53. A model airplane and base as defined in claim 48, wherein said base magnet north pole being directed toward said top surface and said model airplane magnet north pole is disposed on said outer edge.

54. A model airplane and base as defined in claim 48, wherein said base magnet south pole being directed toward said top surface, and said model airplane magnet south pole is disposed on said outer edge.

55. A levitated object and base comprising:

a base defining an interior space;

a support plate extending perpendicular to said base;

at least one base magnet, said base magnet being a permanent magnet having a north pole and a south pole;

a levitated object selected from the group: toothbrush, hairbrush, comb, razor, ruler, calculator, photograph frame, lipstick, calendar, notepad, and flashlight said levitated object defining an interior space, having a base end, levitated end and a midpoint; and at least one levitated object magnet connected to said levitated object, said levitated object magnet being a permanent magnet having a north pole and a south pole, and said levitated object being selectively levitated from said base.

56. A levitated object and base as defined in claim 55, wherein said base is further comprised of a top surface, a bottom surface, a support plate connection point, a near end, and a far end.

57. A levitated object and base as defined in claim 56, wherein said support plate is connected to said base at said support plate connection point, said support plate has a contact face.

58. A levitated object and base as defined in claim 57, wherein said base magnet is located between said support plate connection point and said near end.

59. A levitated object and base as defined in claim 56, wherein said base magnet is curved concave to said top surface of said base, said top surface being shaped to match the curvature of said base magnet.

60. A levitated object and base as defined in claim 58, wherein said levitated object magnet is shaped from the group consisting of: toroid, sphere and disk.

61. A levitated object and base as defined in claim 60, wherein said levitated object magnet further comprises an outer edge and an inner edge.

62. A levitated object and base as defined in claim 61, wherein said levitated object magnet is disposed within said levitated object.

63. A levitated object and base as defined in claim 62, wherein said levitated object is positioned:

above said base, between said near end and said support plate connection point so said base magnet and said levitated object magnet are substantially aligned with each other, and said base end of said levitated object is in contact with said support plate contact face when said base magnet and said levitated object magnet are aligned so said levitated object will levitate.

64. A levitated object and base as defined in claim 63, wherein said base magnet and said levitated object magnet are of a predetermined strength allowing said levitated object to levitate substantially parallel and at a predetermined distance from said top surface of said base.

65. A levitated object and base as defined in claim 64, wherein said base contains more then one base magnet, said base magnets are spaced apart from each other but still within the area defined by said support plate connection point and said near end.

66. A levitated object and base as defined in claim 65, wherein said levitated object contains more then one levitated object magnet, said levitated object magnets are spaced apart from each other, but still within said interior of said levitated object.

67. A levitated object and base as defined in claim 66, wherein said levitated object is balanced about its midpoint.

68. A levitated object and base as defined in claim 66, wherein said levitated object is not balanced about its midpoint, said levitated object magnets and said base magnets vary in strength to allow said levitated object to levitate substantially parallel to said top surface of said base.

69. A levitated object and base as defined in claim 64, wherein said base magnet north pole being directed toward said top surface and said levitated object magnet north pole is disposed on said outer edge.

70. A levitated object and base as defined in claim 64, wherein said base magnet south pole being directed toward said top surface, and said levitated object magnet south pole is disposed on said outer edge.

71. A levitated object and base as defined in claim 64, further comprising of a levitated object that can contain a disposable razor, toothbrush, and lipstick within said interior space.

72. A levitated object and base as defined in claim 71, wherein said disposable razor, said disposable toothbrush, and said disposable lipstick can be removed from said interior space.

73. A levitated object and base as defined in claim 72, wherein said disposable razor, said disposable toothbrush, and said disposable lipstick can be inserted into said interior space.

* * * * *